United States Patent [19]

Grinage

[11] 4,295,350

[45] Oct. 20, 1981

[54] KEYHOLE SIGHTER

[76] Inventor: Kim D. Grinage, 636 Eire St., South Haven, Mich. 49090

[21] Appl. No.: 113,013

[22] Filed: Jan. 18, 1980

[51] Int. Cl.[3] ..... E05B 15/08

[52] U.S. Cl. ..... 70/454

[58] Field of Search ..... 70/454, 452, 207, 224

[56] References Cited

U.S. PATENT DOCUMENTS

| | | | |
|---|---|---|---|
| 2,566,490 | 9/1951 | Heinz | 70/454 |
| 2,579,146 | 12/1951 | Heinz | 70/454 |
| 2,941,392 | 6/1960 | Byrne | 70/454 |
| 2,993,362 | 7/1961 | Baccolla | 70/454 |

*Primary Examiner*—Robert L. Wolfe

*Attorney, Agent, or Firm*—Blanchard, Flynn, Thiel, Boutell & Tanis

[57] ABSTRACT

A keyhole sighting device for mounting on a key receiving member at a kehole therein. A shell projects forward from the key receiving member and has a funnel-like interior cavity converging toward and terminating in a key receiving opening for mechanically guiding a key to a keyhole within said key receiving opening. The shell is of elastomeric, light emitting material and is fixed to the key receiving member as by a rearwardly extending elastomeric skirt or rearward facing adhesive layer. A modification employs a light reflecting (e.g. white or light colored) material surface rather than a light emitting material to enhance visibility in the dark.

8 Claims, 7 Drawing Figures

KEYHOLE SIGHTER

FIELD OF THE INVENTION

This invention relates to a keyhole sighting device for mounting on a doorknob, key receiving boss or the like.

BACKGROUND OF THE INVENTION

The present invention arose from recognition of a long-standing problem in finding the keyhole of a door lock in the dark and guiding a key thereto for unlocking the door. Prior attempts to solve this problem have not, insofar as I am aware, been successful. Providing an electric light fixture near the door is of no help when one has forgotten to turn the light on in advance and access to the light switch cannot be obtained without first unlocking the door. Such an electric fixture is also of no assistance when the bulb is burned out, or the fixture is improperly positioned to illuminate the keyhole. Also, it is undesirable from the standpoint of energy wasteage and cost to leave electric lights turned on to illuminate a keyhole when one may not return for several hours or more.

Further, most people cannot be relied on to carry a flashlight with them just in case it may become necessary to unlock a door in the dark. Moreover, while some people do generally carry matches or the like, it is cumbersome and dangerous to simultaneously manipulate matches and keys, particularly while otherwise engaged in carrying packages or holding open a spring-loaded screen door or the like.

Accordingly, the objects of this invention include provision of:

A keyhole sighting device which both by sight and mechanical guidance assists in finding and directing a key into a keyhole in the dark.

A device, as aforesaid, securable to various key receiving members, such as doorknobs, dead lock bosses, and the like.

A device, as aforesaid, which may be mass produced at relatively low cost as a one-piece member equipped to secure itself fixedly to the key receiving member.

A device, as aforesaid, which additionally cushions a doorknob or the like to reduce injury to persons or things bumping thereinto, and which additionally provides a high-friction gripping surface for engaging and rotating a doorknob by hand.

Other objects and purposes of the invention will be apparent to persons acquainted with apparatus of this general type upon reading the following specification and inspecting the accompanying drawings.

SUMMARY OF THE INVENTION

The objects and purposes of the invention are met by providing a keyhole sighting device for mounting on a key receiving member at a keyhole in such member. The device includes a shell having a rearward facing base surface opposing the front surface of the key receiving member. The shell projects forward from such base surface and has a substantially funnel-like interior cavity. The cavity is wide open at the front of the shell and converges rearwardly to a key receiving opening of substantially less diameter through the base surface. The shell has a light emitting material along the surface of the funnel-like cavity, or at least a light reflecting material at such surface.

DETAILED DESCRIPTION

Figure 1:
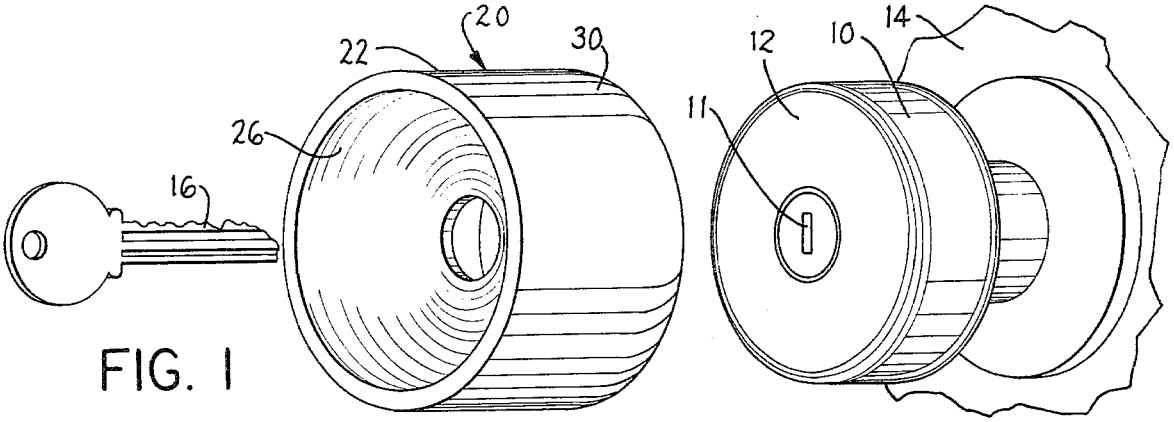
FIG. 1 is a fragmentary, exploded, pictorial view of a device embodying the invention in a position for installation on a doorknob.
Figure 2:
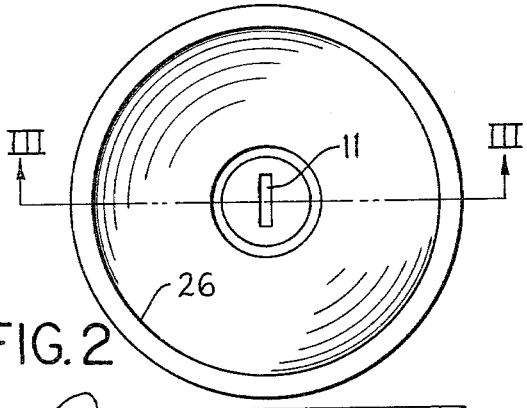
FIG. 2 is a front view of the device of FIG. 1 installed on such doorknob.
Figure 3:
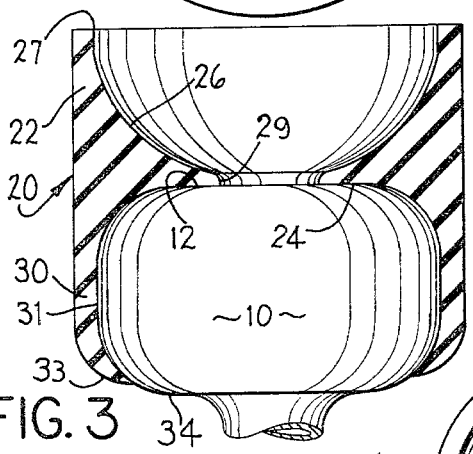
FIG. 3 is a sectional view substantially taken on the line III—III of FIG. 2.

Turning now to the embodiment of FIGS. 1–3, there is shown a conventional key receiving member 10, in the form of a conventional rounded cylindrical doorknob, equipped with a keyhole 11 typically centered on its front surface 12. The doorknob 10 is supported on a door 14 which can be unlocked and opened by insertion of a key 16 into the keyhole 11 for unlocking, and rotation of the knob 10 for unlatching, the door in a conventional manner.

With the foregoing environment in mind, attention is directed to the device 20 embodying the invention. The device 20 is preferably a one-piece member molded of elastomeric material. The device 20 includes a shell 22 having a rearward facing base surface 24 for abutting the front surface 12 of knob 10. The shell 22 projects forardly from the base surface 24 and knob 10, as seen in FIG. 3. The shell has a substantially funnel-like interior cavity 26 having its maximum opening at the front 27 of the shell and converging rearwardly to form a key receiving opening 29 opening through the base surface 24 of the shell and thereby exposing the keyhole 11 centered therewithin.

The funnel-like sides of the cavity 26, when engaged by a key, help to mechanically guide the key rearwardly and radially inwardly toward the key receiving opening 29 and thus to the keyhole 11 preferably centered therein. The sides of the key receiving opening 29 extend a short distance forwardly from the front surface 12 of the knob 10 to laterally trap the key and prevent its unintended radial sliding out of the key receiving opening and hence away from the keyhole 11.

In the preferred embodiment shown, the funnel-like cavity 26 is substantially semispherical in shape, rather than conical, both to reduce the amount of material required to form the device 20 and also to provide person holding the key with an additional tactile clue that his key is more closely approaching the center of the device and hence the keyhole, by reason of the change in slope of the wall of the cavity 26 as seen in cross section in FIG. 3. More particularly, such slope goes from steep to gradual as the key more closely approaches the keyhole.

In the embodiment shown in FIGS. 1–3, the device 20 is further provided with an annular skirt 30 of elastomeric material extending rearward from the base surface 24 and shell 22. The skirt 30 is of relatively thin cross section and is sized radially to fit snugly over the periphery 31 of a conventional doorknob 10. The skirt 30 extends rearward beyond the maximum diameter portion of the knob 10 and has a radially inwardly offset (i.e., bent or tapered) annular edge portion 33 at the rear end thereof which overlaps onto the rear surface 34 of the knob 10 so as to resiliently resist forward movement of the device 20 off the knob 10. In this way, the resilient annular edge portion holds the device 20 on the knob 10 during use. The overlapping annular edge portion 33 is sufficiently radially stretchable as to permit intentional, forceable removal of the device 20 from the knob by forward pulling, and also to allow forceable rearward movement of the device 20 onto the knob 10 to install same. Though not required in use, an adhesive may be used to permanently bond the device 20 to the knob, as to avoid theft of the device 20.

For a conventional doorknob having a diameter of about $1\frac{7}{8}$ inches, typical approximate dimensions for the device 20 can be $2\frac{1}{4}$ inches outside diameter, $1\frac{7}{8}$ inches maximum diameter of cavity 26, $\frac{3}{4}$ inch diameter of the key receiving opening 29, 1 inch overall depth of the cavity 26 and key receiving opening 29, and overall axial depth of $2\frac{1}{4}$ inches. The maximum diameter of the front of the cavity 26 can be varied in size, dimensions in the range of $1\frac{1}{2}$ inches to $2\frac{1}{2}$ inches being preferred.

The device 20 is preferably substantially cylindrical in outer peripheral configuration and has its maximum radial material thickness extending outward from the key receiving opening 29. The entire device 20 is preferably one piece of elastomeric material and offers a firm gripping surface to the hand of the user in the region of the knob 10, due to direct backing of the skirt 30 by the periphery of the knob and also due to the greater material thickness immediately radially outboard of the key receiving opening 29. On the other hand, the forward edge extremity of the shell 22 is relatively thin and is unbacked by the knob and hence can be readily made to deflect when bumped by a person or thing, to reduce injury to such person or thing.

A preferred material for the device 20 is a 30–50 durometer SBR rubber texture using rubber of a light gum stock which is stretchable. The use of generally equivalent materials is contemplated.

An important further feature of the device 20 is that it is treated to glow in the dark. The entire surface of the device 20 may be treated to glow in the dark, but in any event the surface of cavity 26 is treated to glow in the dark. To bring about the glowing effect, permanently glowing or light energized materials, such as phosphorescent materials, or the like, can be added to the rubber substance prior to molding, or after molding of the device 20 the latter can be coated with or submerged in glow producing, e.g., phosphorescent paint which is absorbed through the pores in the relatively soft rubber material. In the latter instance, the device 20 is rinsed after retrieval from its submergence and the glowing material is retained in the pores of the rubber.

In use, the soft glow of light emitted by the device 20 guides the user to the location of the knob and the dark spot in the middle of the funnel-like cavity of the device (defined by the key receiving opening 29) is readily discernible by contrast to the surrounding glow of the surface of the cavity 26. As the user moves his key in the general direction of the knob 10, he can easily guide the key into the cavity 26 due to the glow emitted and can further visually guide the key rearwardly along the cavity toward the dark spot marking the location of the keyhole 11. At the same time, the key may be mechanically guided by contact with the wall 26 of the cavity, toward the key receiving opening and keyhole 11.

MODIFICATIONS

Figure 4:
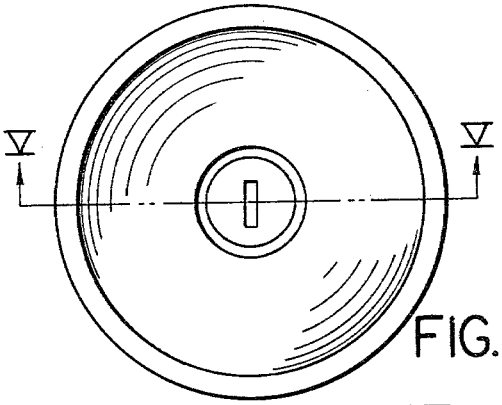
FIG. 4 is a front view of a second embodiment of the device embodying the invention, disposed on a doorknob of modified shape.
Figure 5:
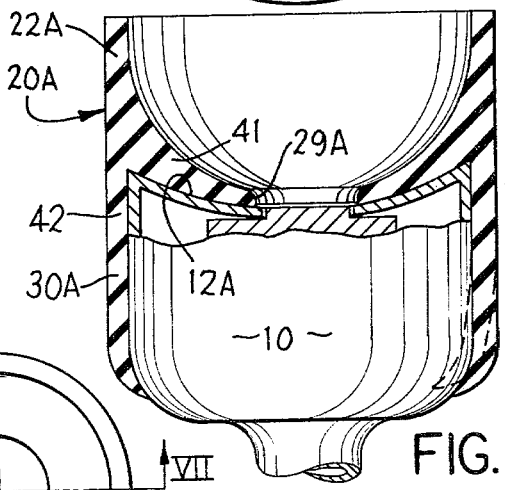
FIG. 5 is a sectional view substantially taken on the line V—V of FIG. 4.

FIGS. 4 and 5 disclose a modified device 20A embodying the invention. The modified device 20A is similar to above-described device 20 except for configuring of the rear end portion 41 of its shell 22A and the joining forward portion 42 of its skirt 30A to snugly fit a knob of different form, here to fit the concave forward surface 12A of a conventional tulip-shaped knob 10A. In the particular embodiment shown, because of the greater depth of the knob 10A, the skirt 30A is longer than in the embodiment of FIGS. 1–3, and the thickened cross section portion 41 curves forwardly rather than rearwardly as it extends outward from the key receiving opening 29A. The device 20A is otherwise similar in structure and operation to the device 20 above described with respect to FIGS. 1–3.

Figure 6:
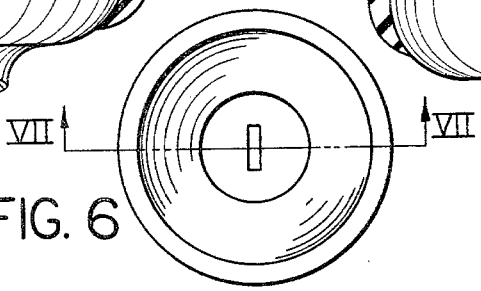
FIG. 6 is a front view of a third embodiment of a device according to the invention installed on the boss of a dead bolt.
Figure 7:
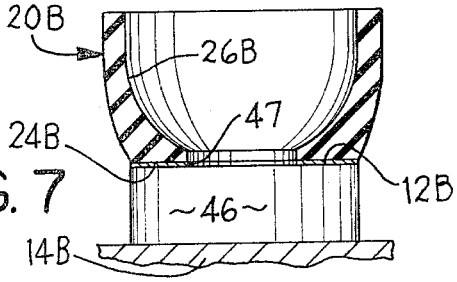
FIG. 7 is a sectional view substantially taken on the line VII—VII of FIG. 6.

FIGS. 6 and 7 disclose a further modified device 20B embodying the invention and adapted for use with the boss 46 of a dead bolt installed on a door 14B, rather than on a knob as above described with respect to FIGS. 1–5. The device 20B does not include a skirt, but rather is secured to the dead bolt boss 46 by means of an adhesive layer 47 provided on the rearward surface 24B thereof for adhesively gripping the front surface 12B of the dead bolt boss 46. A dead bolt boss is typically smaller in diameter than a conventional doorknob, for example about $1\frac{1}{2}$ inches in diameter, and accordingly to avoid undue diminishing of the diameter at the mouth, or forward end, of the funnel-like cavity 26B, the shell 20B flares radially outwardly as it extends forwardly from the boss 46. In the particular embodiment shown, the maximum diameter of the cavity 26B is about equal to the diameter of the dead bolt boss 46.

The construction and operation of the device 20B are otherwise similar to that above described with respect to the embodiments of FIGS. 1–5.

As a further modification, it is contemplated that the entire surface of the device 20, or at least the surface of the cavity 26, instead of incorporating a light emitting material, may instead be light reflective, for example of white or light colored material, so as to enhance the visibility of the cavity by reflection of even relatively low ambient light, such as moonlight, starlight, distant street lights, and the like.

Although preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A keyhole sighting device for mounting on a key receiving member at a keyhole in said member, comprising:

a shell having a rearwardly facing base surface for opposing the front surface of said key receiving member, said shell projecting forwardly from said base surface, said shell having a substantially funnel-like interior cavity, said cavity being wide open at the front of said shell and converging rearwardly to a key receiving opening of substantially less diameter through said base surface, said shell having a night visible material along the surface of said funnel-like cavity;

an annular skirt of elastomeric material extending rearward from said base surface for snug telescoping over the key receiving member, said annular skirt having a generally radially inwardly offset annular edge portion at the rear end thereof and circumferentially stretchable to fit over and grip the rear portion of the key receiving member for holding the device on the key receiving member with said key receiving member snugly closed within said skirt, the entire device being an annular one-piece member of said elastomeric material defining said shell and skirt, said member having a substantially cylindrical peripheral surface continuing from the front end of said shell substantially to the rear end of said skirt.

2. The device of claim 1, in which said annular member has a maximum peripheral wall thickness around said key receiving opening.

3. The device of claim 1, including an adhesive layer on said base surface for adhesive securement of said shell on the front face of a key receiving member, the peripheral wall of said shell being thickest at said base surface.

4. The device of claim 1, in which said funnel-like cavity is semispherical in shape.

5. The device of claim 1, in which said device is constructed of porous elastomeric material, said night visible material being applied at least to the surface of the elastomeric material of said device and enhancing visibility in the dark throughout at least the interior of said funnel-like cavity except at said key receiving opening therein.

6. The device of claim 5, in which said night visible material is a light emitting material.

7. The device of claim 6, in which said light emitting material is a phosphorescent material.

8. The device of claim 5, in which said night visible material is a light colored material.

* * * * *